United States Patent [19]

Katoh

[11] Patent Number: 4,703,296

[45] Date of Patent: Oct. 27, 1987

[54] THERMAL REED SWITCH ASSEMBLY

[75] Inventor: Tomio Katoh, Tokyo, Japan

[73] Assignee: TDK Corporation, Tokyo, Japan

[21] Appl. No.: 826,634

[22] Filed: Feb. 6, 1986

[30] Foreign Application Priority Data

Feb. 7, 1985 [JP] Japan ..... 60-16074[U]

[51] Int. Cl.[4] ..... H01F 27/30

[52] U.S. Cl. ..... 335/208; 335/217

[58] Field of Search ..... 335/207, 208, 151, 153, 335/146, 217; 336/179

[56] References Cited

U.S. PATENT DOCUMENTS

| | | | |
|---|---|---|---|
| 2,877,315 | 3/1959 | Oliver | 335/153 |
| 3,663,913 | 5/1972 | Kato et al. | 336/179 |
| 3,895,328 | 7/1975 | Kato et al. | 335/208 |
| 3,947,794 | 3/1976 | Newcomb | 335/217 |
| 4,320,370 | 3/1982 | Itou et al. | 335/208 |
| 4,325,042 | 4/1982 | Endo et al. | 335/208 |
| 4,389,628 | 6/1983 | Sato et al. | 335/208 |
| 4,509,029 | 4/1985 | Bradley | 335/208 |

FOREIGN PATENT DOCUMENTS 55-35425 3/1980 Japan .

*Primary Examiner*—Arthur T. Grimley
*Assistant Examiner*—Jane Lau
*Attorney, Agent, or Firm*—Armstrong, Nikaido, Marmelstein & Kubovcik

[57] ABSTRACT

A thermal reed switch assembly including two magnetic reed switches having two permanent magnets and at least two semicylindrical thermal magnetic members each having mutually different magnetic tansition points sandwiching the reed switch therebetween. An inner diameter of one thermal magnetic member may be larger than at least a second member therein increasing the sectional area ratio of the members.

12 Claims, 12 Drawing Figures

(a)

(b)

FIG. 9 (a) PRIOR ART
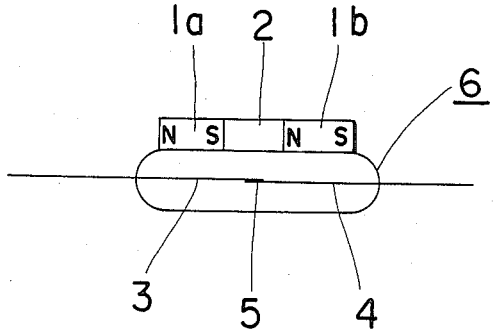
FIG. 9 (b) PRIOR ART
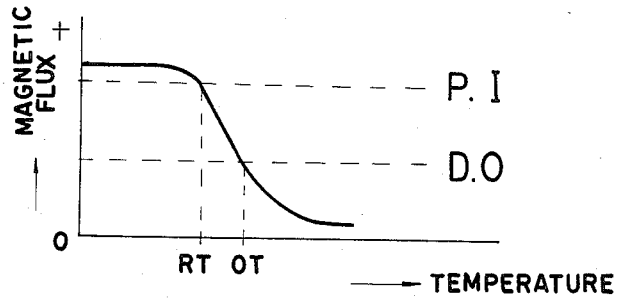

THERMAL REED SWITCH ASSEMBLY

BACKGROUND OF THE INVENTION

1. Field of the Invention

The present invention relates to a thermal reed switch assembly which is capable of performing a bandless operation with adjustment of an operating temperature and achieving a widened difference range between its operating temperature and reset temperature by selectively establishing such two temperatures at desired points respectively.

2. Description of the Prior Art

In the conventional thermal reed switch assembly of bandless operation type combined with a thermal magnetic member and a permanent magnet so as to be turned off (or on) above a certain temperature or turned on (or off) below such temperature, it is necessary to select each time a proper thermal magnetic member of the material composition that indicates required characteristic change relative to the operating temperature, and accordingly a plurality of thermal magnetic members of different material composition need to be prepared for individual operating temperatures. Therefore a problem has been existent heretofore that unless various kinds of thermal magnetic members are prepared, it is impossible to produce a satisfactory thermal reed switch assembly which functions at any desired operating temperature.

Furthermore, since merely one thermal magnetic member is employed, once the operating temperature is established, the reset temperature is determined at a given lower point (e.g. lower by 3°–4° C.), whereby it is rendered impossible to select desired temperatures respectively or to increase the temperature difference therebetween to a desired range.

An exemplary thermal reed switch assembly known heretofore is so composed as shown in FIGS. 9 (*a*) and 9(*b*).

FIG. 9 (*a*) is a sectional view of a conventional break type reed switch assembly (whose contacts are disconnected above its operating temperature), and FIG. 9 (*b*) graphically shows the principle of operation of the thermal reed switch with the relationship between the temperature and the magnetic flux which flows in the contact region of the switch (where the flux flowing rightward in the drawing is positive). In FIG. 9(*a*), the reed switch 6 has a contact region 5 in the axial center of an elongated glass receptacle, and two ferromagnetic reed pieces 3 and 4 supported in the receptacle extend axially from the contact region 5 in mutually opposite directions. Designated at 1*a* and 1*b* are permanent magnets whose magnetic transition point (Curie point) is sufficiently higher than the operating temperature, and a thermal magnetic member 2 having a Curie point equivalent to the operating temperature is disposed opposite to the contact region 5. On the two sides of the thermal magnetic member 2, the permanent magnets 1*a* and 1*b* are attached firmly to the reed switch 6 while being opposed to the reed pieces 3 and 4 in such a manner that the direction of magnetization thereof becomes coincident with the axial direction of the reed switch. Assume now that a temperature rise occurs in the above arrangement. Since the thermal magnetic member 2 remains ferromagnetic under its Curie point, the magnetic flux flowing from the magnet 1*b* to the magnet 1*a* mostly passes through the magnetic member and thereby forms a magnetic circuit which extends by way of the reed pieces 3 and 4, so that the magnetic flux flowing in the contact region 5 provides a great force of attraction sufficient to retain the contacts at the attracted positions thereof against the elasticity of the reed pieces 3 and 4. Such magnetic flux flowing in the contact region 5 gradually decreases in accordance with temperature rise, as represented by the curve shown in FIG. 9 (*b*). That is, the saturation flux density of the thermal magnetic member 2 is reduced and consequently the magnetic flux flowing therein leaks out to the contact region 5. The leakage flux is directionally reverse to the magnetic flux passing through the contact region 5 and, as a result of the mutual cancellation thereof, the flux flowing in the contact region 5 decreases. When the flux thus reduced reaches the value D.O, the elasticity of the reed pieces 3 and 4 overcomes the remaining force of attraction and thereby separates the contacts from each other. The temperature (represented by OT) at this moment is the operating temperature. On the other hand, when there occurs a temperature fall from a point higher than the operating temperature, the magnetic flux fails to provide, even after arrival of the temperature at OT, a great force of attraction sufficient to overcome the elasticity of the reed pieces 3 and 4. And upon arrival at the temperature represented by RT (reset temperature), the magnetic flux P.I capable of providing a great force of attraction sufficient to attract the contacts against the elasticity of the reed pieces 3 and 4 comes to flow again in the contact region 5.

In the assembly of the above-mentioned structure where merely one thermal magnetic member is employed, it is difficult to achieve an increased difference (temperature hysteresis) between the operating temperature and the reset temperature by selectively establishing them at desired points respectively, and fine adjustment is not executable either.

There is known one prior art as disclosed in Japanese Patent Laid-open No. 35425/1980, wherein two ring-shaped thermal magnetic members having mutually difference Curie points are arrayed axially and interposed between permanent magnets. In this example, however, there exists a disadvantage that when one magnetic member of a lower Curie point loses its magnetism, no magnetic flux is generated to consequently bring about failure in retaining the switch in its on-state.

SUMMARY OF THE INVENTION

The present invention has been accomplished in view of the circumstances mentioned above. And its object is to provide an improved bandless type thermal reed switch assembly wherein a wide temperature hysteresis range is attainable by establishing both an operating temperature and a reset temperature at desired points respectively, and fine adjustment is executable as well with another advantage of ensuring high operational reliability.

In order to achieve the above object, the feature of the present invention resides in a novel structure wherein at least two permanent magnets are disposed in the peripheral vicinities of the contact region of a reed switch having two magnetic reed pieces, in such a manner that the poles of the permanent magnets are directionally coincident with the axes of the reed pieces, and at least two thermal magnetic members having mutually different magnetic transition points are so disposed as to sandwich the reed switch therebetween in the direction intersecting the axis of the reed switch.

BRIEF DESCRIPTION OF THE DRAWINGS

FIG. 1 (*b*) graphically shows the magnetic flux-to-temperature characteristic for explaining the principle of operation;

FIG. 9 (*a*) is a perspective view of a conventional assembly; and

FIG. 9 (*b*) graphically shows the magnetic flux-to-temperature characteristic of the assembly illustrated in FIG. 9 (*a*).

DESCRIPTION OF THE PREFERRED EMBODIMENTS

Hereinafter the present invention will be described in further detail with reference to an exemplary embodiment thereof.

Figure 1:
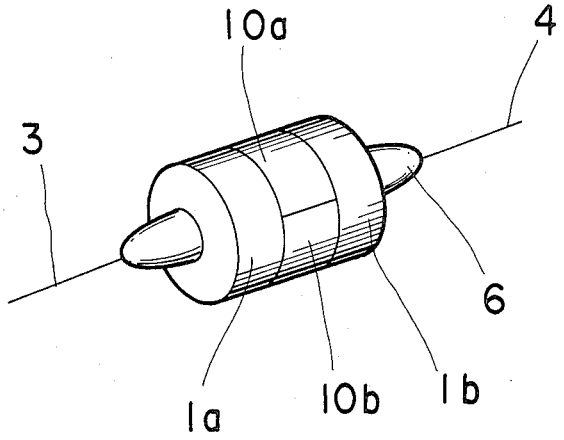
FIG. 1 (*a*) is a perspective view of an exemplary embodiment according to the present invention.
Figure 1:
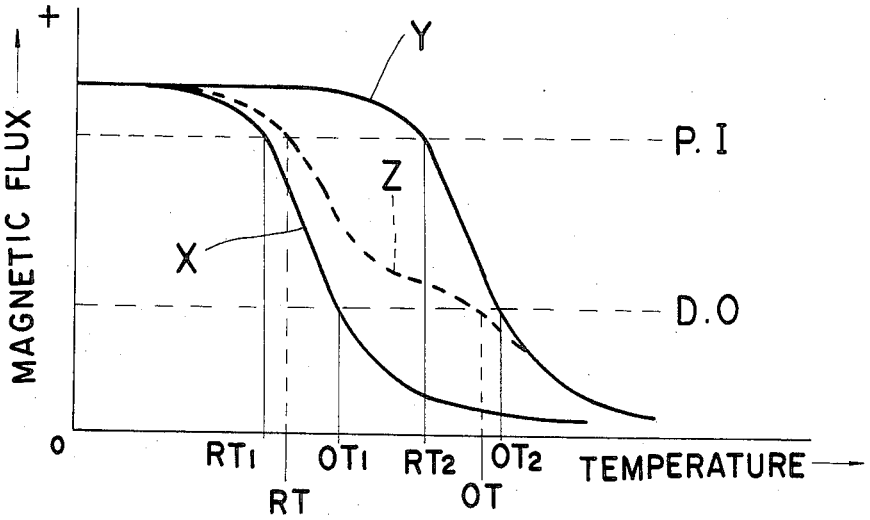

FIG. 1 (*a*) is a perspective view of an exemplary reed switch assembly embodying the invention, and FIG. 1 (*b*) graphically shows magnetic flux-to-temperature characteristic curves for explaining the principle of operation.

In this switch assembly, the aforesaid magnetic member 2 of FIG. 9 (*a*) is replaced with two semicylindrical thermal magnetic members 10*a* and 10*b* which have mutually different Curie points and butt against each other to be cylindrical while sandwiching the reed switch 6 therebetween. In FIG. 1 (*b*), a curve X represents the characteristic of the thermal reed switch obtained when one thermal magnetic member 10*a* is shaped into a ring and is used solely, and a curve Y represents the characteristic obtained when another thermal magnetic member 10*b* is used solely. Meanwhile, a curve Z plotted by a broken line between the foregoing two curves represents the characteristic achieved by the present invention, wherein the operating temperature OT is within an intermediate region of OT1–OT2 and at a position closer to OT2, and the reset temperature RT is within an intermediate region of RT1–RT2 and at a position closer to RT1, so that the difference (temperature hysteresis) between the operating temperature and the reset temperature can be established to have a wide range.

Figure 2:
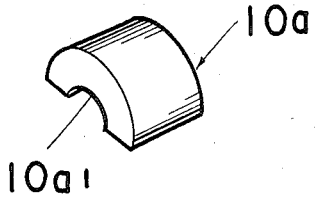
FIGS. 2 (*a*) and 2 (*b*) are perspective views illustrating exemplary shapes of thermal magnetic members employed in the embodiment of FIG. 1 (*a*)
Figure 2:
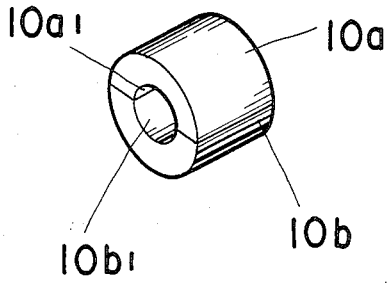

With regard to the shape and combination of the thermal magnetic members 10*a* and 10*b* employed in the above embodiment, there may be contrived a variety of modifications. For example, it is usual to prepare a thermal magnetic member 10*a* of FIG. 2 (*a*) which is semicylindrical in cross section and has an inner circumference $10a_1$ substantially equal to the outer semicircle of the reed switch 6, and another semicylindrical thermal magnetic member 10*b* equal in shape thereto is combined with the member 10*a* to constitute a cylindrical unit of FIG. 2 (*b*).

Figure 3:
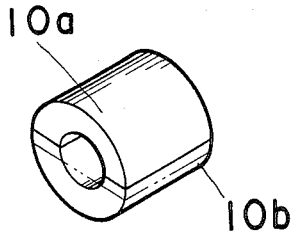
FIGS. 3 and 4 are perspective views illustrating other exemplary shapes of thermal magnetic members.

In another example of FIG. 3, one thermal magnetic member 10*a* is shaped to be arcuate in cross section while another thermal magnetic member 10*b* is shaped into a U in such a manner as to support the remaining cylinder portion, and the sectional area ratio of the two members may be changed.

Figure 4:
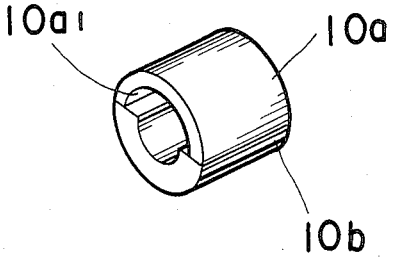

Furthermore, as shown in FIG. 4, the sectional area ratio of the two thermal magnetic members 10*a* and 10*b* may be changed by increasing the inner diameter (thickness) $10a_1$ of one member.

Figure 5:
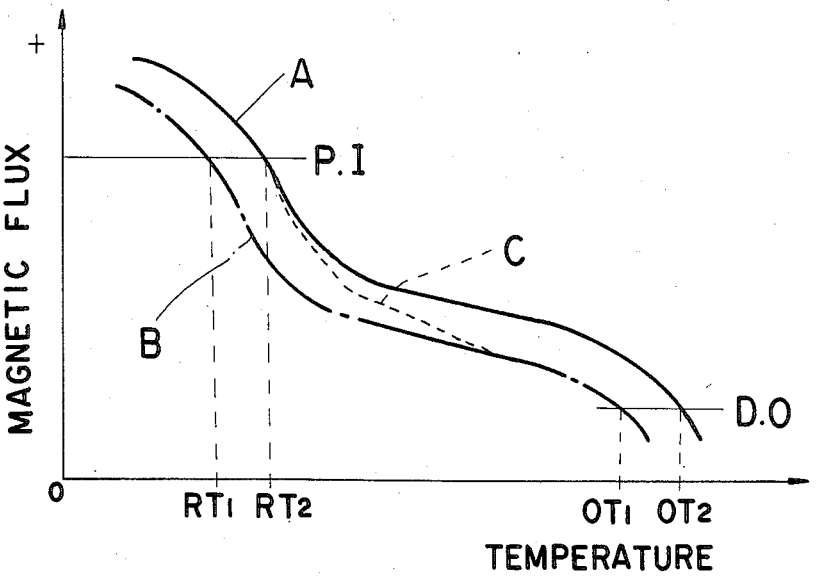
FIG. 5 graphically shows the magnetic flux-to-temperature characteristic for explaining the operation of a modification.

FIG. 5 graphically shows the characteristic achieved in the case where the sectional area ratio of the two thermal magnetic members 10*a* and 10*b* is changed and the temperature hysteresis range is widened by selecting the Curie points thereof to be considerably different from each other. In this graph, a curve A represents the result obtained by decreasing the inner diameter of the cylindrical thermal magnetic member (i.e. by increasing the cross-sectional area). The curve A shifts upward as the sectional area becomes further greater. Meanwhile a curve B represents the result obtained by increasing the inner diameter of the cylindrical thermal magnetic member (i.e. by decreasing the sectional area) contrary to the preceding example. The curve B shifts downward with a further decrease of the cross-sectional area. And another curve C plotted by a broken line represents the result obtained by increasing the inner diameter of merely one thermal magnetic member (10*a* in FIG. 4) having a higher Curie point, denoting that both the operating temperature and the reset temperature are adjustable.

Thus, fine adjustment of the characteristic is rendered possible by altering the sectional area, and the operating point is shiftable by selectively changing the material.

In the break type thermal reed switch assembly of the present invention described hereinabove, a variety of advantages are attainable including that the temperature hysteresis range can be widened and high operational reliability is ensured by the following reasons. First, due to the disposition of thermal magnetic members over and under the reed switch, the magnetic flux passing through one thermal magnetic member of a higher Curie point is maintained even when another thermal magnetic member of a lower Curie point loses its magnetism, thereby retaining the switch in its on-state. Consequently its off-action is determined by the higher Curie point. Furthermore, since the sectional area is defined, the passing magnetic flux is thereby restricted to retain the off-state with certainty if the temperature falls below the higher Curie point during the downward fluctuation thereof. And upon arrival of the temperature at the lower Curie point, the magnetic flux is suddenly increased to immediately turn on the switch. Accordingly, the on-off action can be performed with certainty.

In addition, both the operating temperature and the reset temperature are selectively changeable by varying the sectional area ratio of the thermal magnetic members as mentioned above, hence facilitating fine adjustment of the characteristic.

Figure 6:
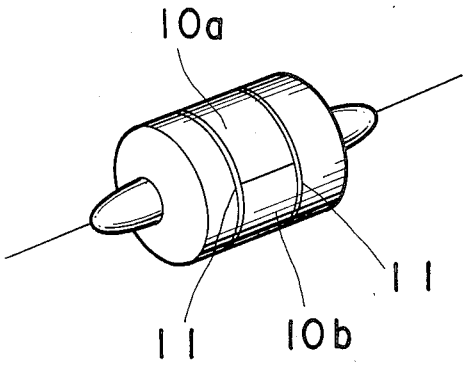
FIGS. 6 and 7 are perspective views of further exemplary embodiments according to the invention.
Figure 7:
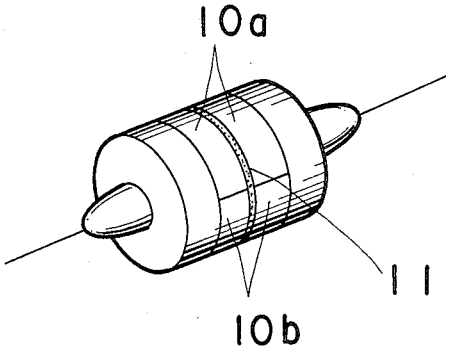
Figure 8:
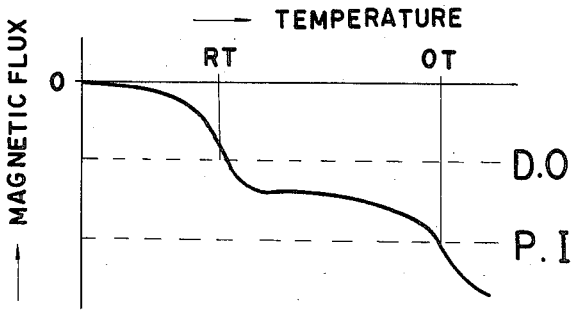
FIG. 8 graphically shows the magnetic flux-to-temperature characteristic of the assemblies illustrated in FIGS. 6 and 7.

Although the foregoing embodiment is concerned with a break type thermal reed switch assembly, the present invention is applicable also to a make type as shown in FIGS. 6 and 7. In the example of FIG. 6, two spacers 11 are positioned on the two sides of thermal magnetic members to form gaps. And in another example of FIG. 7, two pairs of thermal magnetic members are disposed with one spacer 11 inserted therebetween to form a gap. In either of such two examples, the magnetic flux-to-temperature characteristic curve is such as plotted in the graph of FIG. 8.

It is to be understood that the present invention is not limited to the foregoing embodiments alone, and a variety of modifications are contrivable.

For example, the shape of each thermal magnetic member need not exactly be cylindrical or the like, and it may be prismatic or elliptic as well. The essential requisite resides merely in the point that such magnetic members are in the shape obtained by dividing a hollow post longitudinally.

As described in detail hereinabove, the present invention realizes an improved thermal reed switch assembly in which a wide temperature hysteresis range can be attained with another advantage of ensuring high operational reliability.

Since both the operating temperature and the reset temperature can be established at desired points respectively, the use of a single thermal reed switch assembly of the present invention is sufficient to achieve the purpose in an exemplary case of employing the invention in an antifreezing mechanism of a heat pump type air conditioner or the like, as compared with a conventional application where signals for starting a defrost mode (at −3° C.) and ending it (at 14° C.) are obtained from individual sensors separately.

Furthermore, in another case of applying the invention to temperature control in an engine room of a vehicle, remarkable effect is attainable by the use of a single thermal reed switch assembly in a wide temperature difference range by driving, for example, a cooling fan in response to temperature rise up to a predetermined high point and stopping the fan in response to temperature fall down to a predetermined low point.

I claim:

1. A thermal reed switch assembly comprising: a reed switch including two magnetic reed pieces with tip ends disposed as contacts in a mutually overlapping relation and a tube covering said two magnetic reed pieces including said contacts;

two cylindrical permanent magnets disposed around said tube in the vicinity of said contacts and spaced from each other; and a cylindrical thermal magnetic body disposed between said two cylindrical permanent magnets and comprising two semicylindrical thermal magnetic members each having mutually different magnetic transition points and including ends of said two semicylindrical thermal magnetic members held in abutment against each other in a sandwiching relation to said reed switch.

2. A thermal reed switch assembly comprising: a reed switch having contacts in two magnetic reed pieces; at least two permanent magnets disposed in their peripheral vicinity of said contacts of said reed switch, said at least two permanent magnets having poles which are directionally coincident with the axis of said reed pieces; and at least two thermal magnetic members each having mutually different magnetic transition points, said thermal magnetic members sandwiching said reed switch therebetween in the direction intersecting the axis of said reed switch, an inner diameter of one thermal magnetic member being larger than at least a second thermal magnetic member therein increasing the sectional area ratio of said thermal magnetic members.

3. The reed switch assembly according to claim 1, wherein said thermal magnetic members are changed in thickness to have a different sectional area ratio and wherein a gap is formed between each of said permanent magnets and said thermal magnetic members.

4. The reed switch assembly according to claim 3, wherein a plurality of groups of said thermal magnetic members are disposed axially, and a gap is formed between said groups.

5. The reed switch assembling according to claim 1, wherein said thermal magnetic members are changed in definite area to have a different sectional area ratio.

6. The reed switch assembly according to claim 5, wherein said thermal magnetic members are changed in thickness to have a different sectional area ratio and wherein a gap is formed between each of said permanent magnets and said thermal magnetic members.

7. The reed switch assembly according to claim 6, wherein a plurality of groups of said thermal magnetic members are disposed axially, and a gap is formed between said groups.

8. The reed switch assembly according to claim 5, wherein said thermal magnetic members are changed in thickness to have a different sectional area ratio and wherein a plurality of groups of said thermal magnetic members are disposed axially, and a gap is formed between said groups.

9. The reed switch assembling according to claim 1 or 5, wherein said thermal magnetic members are changed in thickness to have a different sectional area ratio.

10. The reed switch assembly according to claim 1 or 5, wherein a gap is formed between each of said permanent magnets and said thermal magnetic members.

11. The reed switch assembly according to claim 1 or 5, wherein a plurality of groups of said thermal magnetic members are disposed axially, and a gap is formed between said groups.

12. The reed switch assembly according to claim 1, wherein said thermal magnetic members are changed in thickness to have a different sectional area ratio and wherein a plurality of groups of said thermal magnetic members are disposed axially, and a gap is formed between said groups.

* * * * *